United States Patent [19]

Maitland

[11] Patent Number: 5,016,613

[45] Date of Patent: May 21, 1991

[54] FIREPLACE TOP WALL ASSEMBLY AND COOLING SYSTEM

[75] Inventor: Kenneth R. Maitland, Humboldt, Tenn.

[73] Assignee: Majco Building Specialties, L.P., Huntington, Ind.

[21] Appl. No.: 552,255

[22] Filed: Jul. 12, 1990

[51] Int. Cl.[5] ..... F23J 11/00

[52] U.S. Cl. ..... 126/312; 126/319; 126/301; 126/293; 126/500; 126/307 R; 126/531; 98/45

[58] Field of Search ..... 126/312, 307 R, 316, 126/293, 80, 534, 535, 533, 536, 537, 538, 539, 80, 319, 500, 301; 98/45

[56] References Cited

U.S. PATENT DOCUMENTS

| | | | |
|---|---|---|---|
| 171,773 | 1/1876 | Bussel | 126/531 |
| 274,567 | 3/1883 | Cummings . | |
| 2,002,879 | 5/1935 | Blakeman | 126/312 |
| 2,718,841 | 9/1955 | Kinkead | 126/307 R |
| 3,190,281 | 6/1965 | Northwood . | |
| 3,601,117 | 8/1971 | Carson | 126/531 X |
| 3,623,458 | 11/1971 | Block . | |
| 4,319,556 | 3/1982 | Schwartz et al. . | |
| 4,335,704 | 6/1982 | Wingstrom et al. . | |
| 4,519,376 | 5/1985 | Schoeff et al. | 126/531 |
| 4,878,481 | 11/1989 | Schoeff et al. | 126/312 X |

*Primary Examiner*—Larry Jones

*Attorney, Agent, or Firm*—Hoffmann & Baron

[57] ABSTRACT

A fireplace and top wall assembly is disclosed. The top wall assembly includes primary and secondary aligned flue outlet assemblies that form between them a primary air conduit and a secondary flue gas conduit. Both of the conduits are designed to be mounted in fluid communication with the inlet opening of a chimney flue of a fireplace. Flue gases are drawn from the combustion chamber of the fireplace through the secondary flue gas conduit to mix air drawn in by the primary air conduit to promote cooling of the top wall assembly and surrounding fireplace structure.

16 Claims, 2 Drawing Sheets

10
35'
36'
34'
38
31
30
33'
32
33
34
36
35
18'
22
12
14
19'
20
13
16'
22
17'
22
17
16
22
19
18
D

FIREPLACE TOP WALL ASSEMBLY AND COOLING SYSTEM

BACKGROUND OF THE INVENTION

1. FIELD OF THE INVENTION

This invention relates to a fireplace and cooling system, and more particularly, to a top wall assembly and cooling system for a fireplace. The system includes a cooling means which mixes outside air with gases exiting a combustion chamber directly into the flue of the chimney of the fireplace so that fireplace surfaces are cooled and provides a safer, more reliable fireplace system.

2. DESCRIPTION OF PRIOR ART

A combustion chamber having means to divert combustion gases into the flue outlet of a fireplace is described in U.S. Pat. No. 4,519,376 of Schoeff and Hemmert. A combustion chamber includes a top wall assembly having means to divert the mixture of combustion gases and air to the flue outlet opening so as to prevent spillage of smoke and other combustion gases into the room. The diverting means includes a pair of L-shaped brackets positioned adjacent flue outlet opening in the combustion chamber and an inwardly curved base defining a converging nozzle at its lower end is mounted around the flue outlet opening whereby the velocity and turbulence of the mixture of combustion gases and air are reduced and are diverted toward the flue outlet opening to prevent spillage of smoke and other combustion gases into the room.

In U.S. Pat. No. 274,567 there is described a ventilating damper for stoves, pipes, or flues. The damper has an annular, inverted bowl shaped chamber for inserting into the flue. Part of the chamber projects beyond the periphery of the stove-pipe to form a secondary chamber. The secondary air passage has a series of openings at fixed intervals around the chamber and a rotatable damper plate also formed with a series of openings at fixed intervals. When the damper plate is rotated, air that enters the flue is regulated which also draws combustion gases into the flue to provide a cooling effect above the damper.

In U.S. Pat. No. 3,190,281 there is described a prefabricated fireplace for mounting on building walls. An inner smoke chamber extends upwards from the top of the combustion chamber to define a flue pipe. An outer chamber box forms a secondary sleeve which surrounds, and is spaced from the flue pipe to provide an outer smoke chamber. The flue pipe in the secondary sleeve has passageways where there is an exchange of air between the inner and outer smoke chambers thereby cooling the outer sleeve.

In U.S. Pat. No. 3,623,458 there is disclosed a stackless heater for heating swimming pool water. Air enters above the combustion chamber which mixes with the combustion gases to cool the heater.

SUMMARY OF THE INVENTION

An object of the invention is to provide a top wall assembly which is adapted to be mounted to a fireplace of the type having exterior walls enclosing a combustion chamber and a chimney flue to exhaust combustion gases.

Another object of the invention is to provide a top wall assembly for a fireplace which includes primary and secondary vertically aligned flue outlets that form between them a primary air and a secondary flue-gas conduit and both of the conduits being in fluid communication with the flue of the chimney.

Another object of the invention is to provide a top wall assembly of a fireplace which includes spaced apart, upper and lower top wall members having vertically aligned flue outlet openings and each flue outlet opening having mounted in surrounding relation therewith, an inwardly curved member defining a converging nozzle with the upper nozzle being concentrically positioned with respect to the lower nozzle.

A further object of the invention is to provide a top wall assembly which includes a first conduit means to discharge a mixture of air and stagnant combustion gases directly into the flue of the chimney and second conduit means to discharge combustion gases from the combustion chamber into the flue of the chimney so that air discharged from the first conduit means into the chimney flue promotes cooling of the flue gases, top wall assembly and the external surfaces of the fireplace.

A further object of the invention is to provide a top wall assembly of a combustion chamber of a fireplace having means to increase the velocity of air induced between the upper and lower top wall members.

A further object is to provide means to remove stagnant combustion gases from the combustion chamber of a fireplace whereby spillage of combustion gases including smoke is overcome by the increased velocity created by upper and lower nozzles mounted around their respective flue outlet openings of the top wall members of the top wall assembly.

A further object of the invention is to provide a fireplace cooling system in which its external surfaces including the chimney flue remain cool and provides a safer, more reliable fireplace when in operation.

The invention generally contemplates a fireplace system for cooling external surfaces around the top wall and chimney flue without using increased thicknesses of conventional insulating materials. A top wall assembly is provided and is adapted to be positioned in a fireplace to form the top wall of the combustion chamber to the top wall assembly. The top wall assembly includes a pair of spaced apart top wall members. Each top wall member includes a flue outlet opening and the flue outlet openings are vertical aligned. The lower wall member may include a plurality of openings disposed adjacent each corner to provide a passage from the combustion chamber to the annular space between the top wall members. A plurality of holes or openings formed about the perimeter of the fireplace may be used to provide air entrant openings that are positioned between the top wall members to provide communication between the atmosphere and plenum or chamber between the top wall members. The upper and lower top wall members include a pair of inwardly curved portions defining converging nozzles in surrounding relation to the respective flue outlet openings. Each nozzle is in fluid communication with the flue of the chimney. In operation, the combustion gases from the combustion chamber exit through the lower flue outlet opening and at the same time outside or secondary air together with stagnant combustion gases remaining in the combustion chamber flow through the plenum and nozzle of the top wall assembly directly into the chimney flue. The cooler outside air mixes with the combustion gases exiting the combustion chamber thereby cooling the top wall assembly and flue sections of the fireplace and also accelerating the exit of combustion gas.

DETAIL DESCRIPTION OF THE PREFERRED EMBODIMENT

Figure 1:
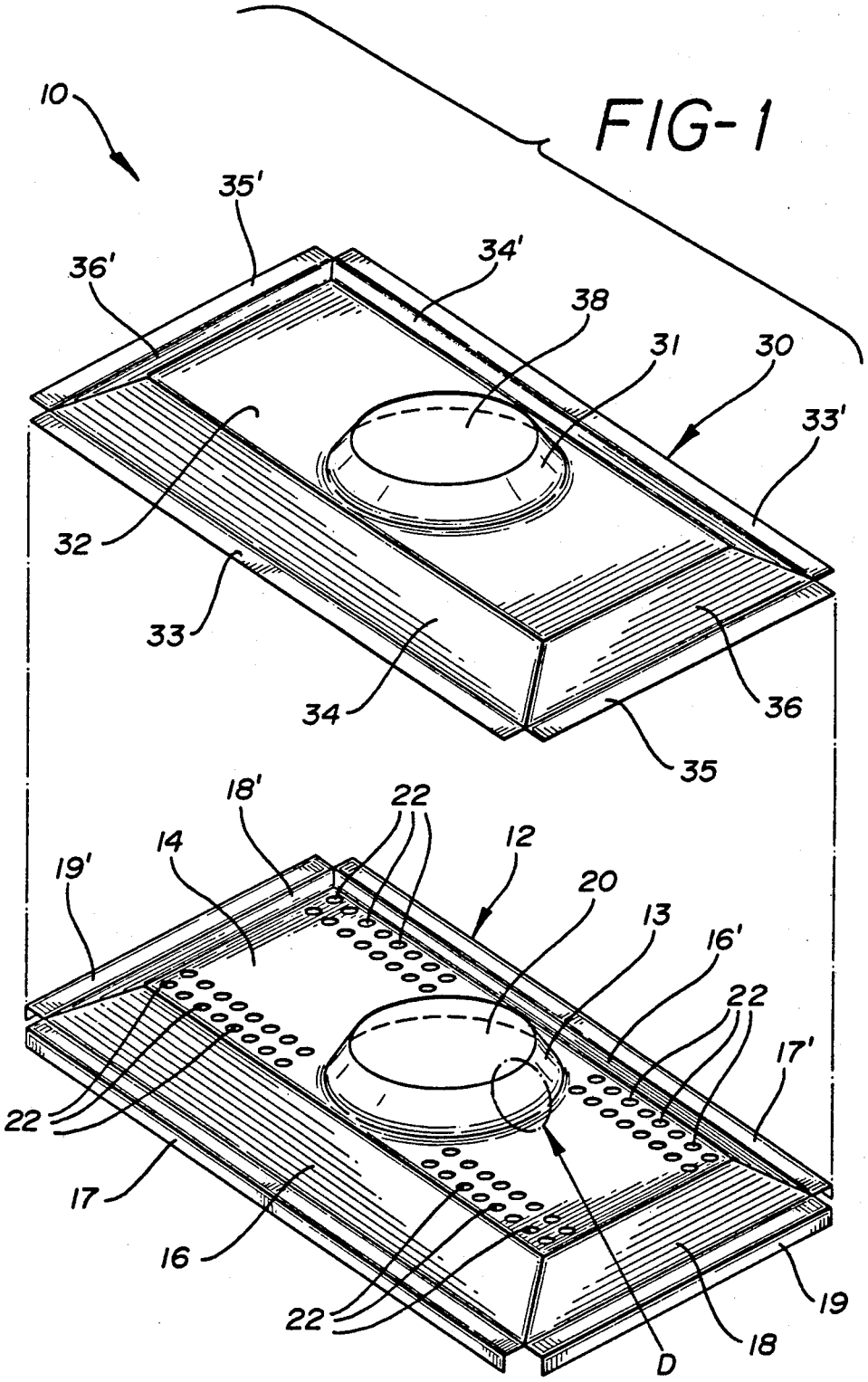
FIG. 1 is an exploded isometric view of the top wall assembly of a combustion chamber for a fireplace, not shown.
Figure 2:
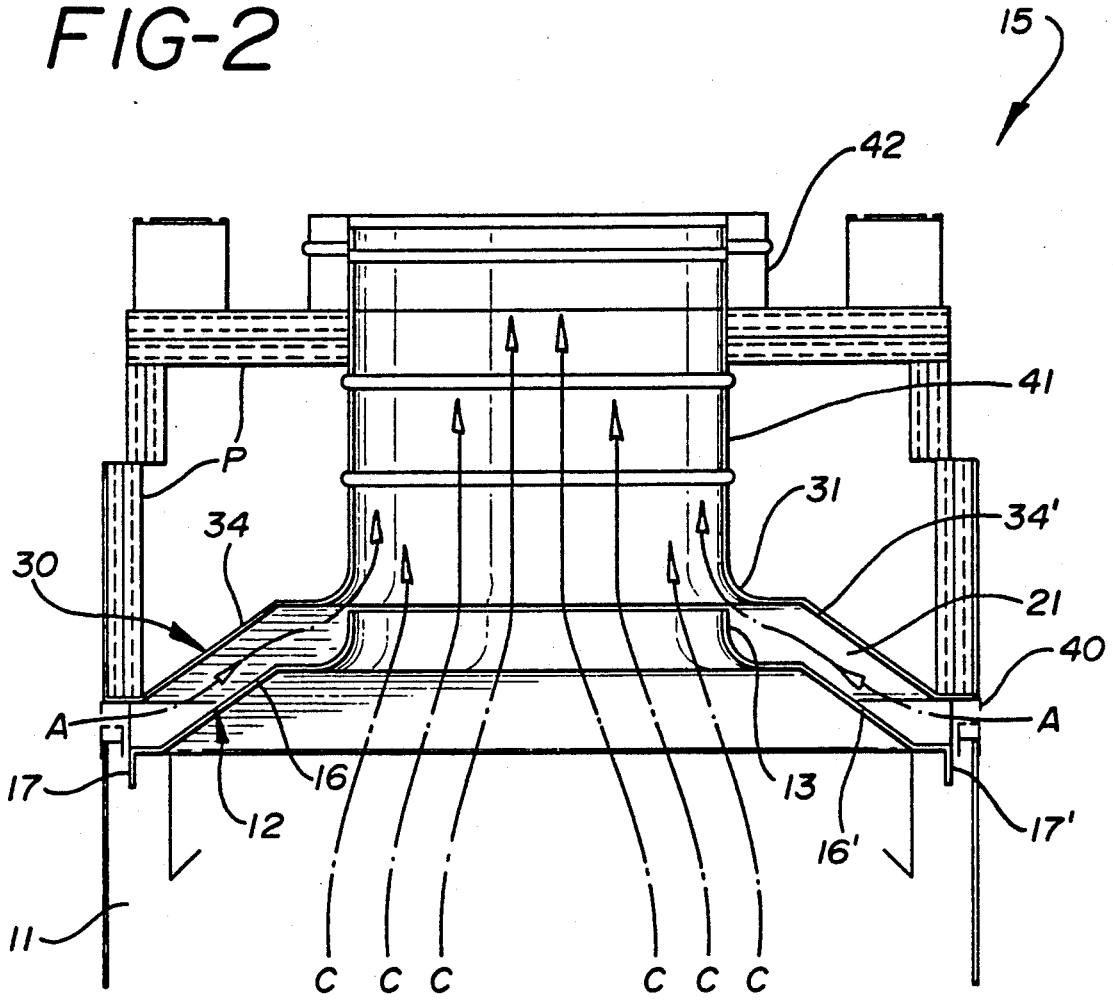
FIG. 2 is an elevational view in section, taken through the flue outlet openings of the top wall assembly of FIG. 1 mounted in partially depicted fireplace and the direction of the arrows schematically illustrate the flow of combustion gases and air discharged directly to the chimney flue.
Figure 3:
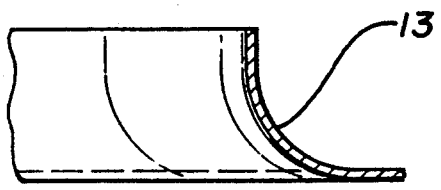
FIG. 3 is a sectional view of a portion of a nozzle shown in area D of FIG. 1.

FIG. 1 shows top wall assembly 10, adapted to form the top of a combustion chamber for a fireplace, not shown. FIG. 2 shows top wall assembly 10 mounted in a fireplace assembly, partially shown. Top wall assembly 10 includes primary combustion dome or wall 12 which is in the form of a rectangular, truncated pyramid having a generally rectangular flat surface 14 that is bounded by opposed side walls 16, 16' and 18, 18'. Surface 14 is formed with flue outlet opening 20 and a plurality of holes 22 positioned generally adjacent the four corners of surface 14. As shown in FIG. 1, the area of the holes of the four corners should be at least about 3 square inches. The holes 22 may be omitted if the flow of combustion gases is satisfactory without them. Each side wall 16, 16'; 18, 18' has extending therefrom, an integrally formed L-shaped skirt or flange 17, 17'; 19, 19' which is mounted to the top of the vertical walls of combustion chamber 11 for fireplace 15, such as is shown in FIG. 2 and as shown in U.S. Pat. No. 4,519,376.

A similarly shaped secondary dome or wall 30 having a generally flat surface 32 is formed with a flue outlet opening 38. When assembled, flue outlet openings 20 and 38 are in vertical alignment. Surface 32 is bounded by opposed side walls 34, 34'; 36, 36' and has extending therefrom, an integrally formed skirt or flange 33, 33'; 35, 35'. By engagement of the flange in a conventional manner, secondary wall 30 is mounted to fireplace 15 and interconnected with primary wall 12 as shown in FIG. 2.

Primary wall 12 and secondary wall 30 of top wall assembly 10 are each provided with an inwardly curved portion 13 and 31, respectively. Each curved portion defines a converging nozzle present and each is mounted in surrounding relation to its respective flue outlet opening 20 and 34. In this manner, the nozzles 13, 31 are mounted in spaced apart, concentric relation with respect to each other and are vertically aligned.

Secondary top wall surface 32 is mounted in overlying, spaced relation to primary surface 12 as shown in FIG. 2. This forms a conduit 21 between top wall members 12 and 30. A plurality of slotted openings 40 are formed in the outer perimeter of the assembly of the corresponding flanges 17, 17'; 19, 19' and 33, 33'; 35, 35' when mounted. This provides communication between the atmosphere outside of the fireplace and conduit 21. A chimney flue 41 is coupled to the nozzle 31 in vertical alignment with the flue outlet openings 20, 38 as shown in FIG. 2. A portion of the chimney flue 41 is enclosed by partitions P. The direction of the arrows schematically illustrate the flow of combustion gases C and cool air A respectively, drawn through flue outlet openings 20 and 38 and into chimney flue 41. A cylindrical collar 42 mounted to the top wall of the fireplace surrounds the flue 41.

In operation, combustion gases C are drawn to flue outlet 20 due to the low pressure created by nozzle 13. At the same time cool air A and stagnant combustion gases C are drawn into the plenum or space defined by separated wall members 12 and 30. Combustion gases C pass through holes 22 and cooling air A enters through slotted openings 40 due to the low pressure created by nozzle 31. The mixture of combustion gases C and cooling air A are discharged directly into flue 41 at the same time combustion gases C are discharged through flue outlet openings 20 and 38. The cool air A combining with the hot combustion gases produces cooling of the mixture. The cooled mixture and cool air produces cooling of the top wall assembly 10, and flue 41. The resultant cooling effect is substantial and sufficient to reduce the standard insulation used in prebuilt fireplaces.

A top wall assembly embodying the present invention which is mounted on a conventional fireplace assembly, such as is shown and disclosed in U.S. Pat. No. 4,519,376, the contents of which are incorporated herein by reference, provides a fireplace system which operates at cooler temperatures. In this manner an improved fireplace assembly is provided.

Thus, while there has been described what is the presently contemplated preferred embodiment of the invention, further changes and modifications should be made by those skilled in the art without departing from the scope of the invention, and it is contemplated to claim all such changes and modifications.

What is claimed is:

1. A top wall assembly for a combustion chamber for a fireplace comprising:

primary and secondary vertically aligned flue outlet assemblies that form between them a primary air conduit means and a secondary flue-gas conduit means; and both of said conduit means being adapted to be mounted in fluid communication with the inlet opening of a chimney flue of a fireplace so that flue gases drawn from a combustion chamber of the fireplace through said secondary flue-gas conduit means to the chimney flue mixes air from the primary air conduit means thereby promoting cooling of the top wall assembly and the chimney flue, wherein said primary and secondary flue outlet assemblies comprise generally rectangular upper and lower, spaced apart, top wall members, each wall member having a flue outlet opening with said flue outlet openings being in vertical alignment; each wall member having an inwardly curved portion defining a converging nozzle mounted in surrounding relation with its respective flue outlet opening, said nozzles being concentrically positioned with respect to each other, and both of said nozzles being adapted to be mounted in fluid communication with the inlet opening of a chimney flue.

2. The top wall assembly of claim 1, wherein said primary air conduit means includes a plurality of openings to form passages that are adapted to be in fluid communication with said combustion chamber to provide means to induce stagnant combustion gases into said primary air conduit means.

3. The top wall assembly of claim 1, wherein said lower top wall member includes a plurality of openings disposed adjacent each corner to provide passages from a combustion chamber of a fireplace to the space defined between said upper and lower top wall members.

4. The top wall assembly of claim 3, wherein the area of said plurality of openings formed in said lower top wall member is at least about three square inches.

5. The top wall assembly of claim 1, wherein said top wall assembly includes a vertical wall formed around the perimeters of said spaced apart top wall members, said vertical wall having a plurality of holes disposed in spaced relation to form entrant openings to permit air to enter the space defined between said upper and lower top wall members.

6. A fireplace comprising:

a plurality of walls defining a combustion chamber;

a chimney flue communicating with said combustion chamber;

a first top wall member including a first flue outlet opening and first nozzle means defined about said first flue outlet opening;

a second top wall member including a second flue outlet opening and second nozzle means defined about said second flue outlet opening, said second top wall member being positioned above said first top wall member such that a space is defined between said first and second top wall members, said first and second flue outlet openings are in substantial vertical alignment, and said first and second flue outlet openings are in fluid communication with said chimney flue;

means for introducing air into said space between said first and second top wall members;

said first and second top wall members being arranged such that combustion gases exiting the combustion chamber pass through said first and second flue outlet openings, respectively, thereby drawing fresh air into said space between said first and second top wall members and accelerating the exit of combustion gas from said combustion chamber.

7. A fireplace, as described in claim 6, wherein said first and second nozzle means are defined by first and second annular walls extending about said first and second flue outlet openings, respectively.

8. A fireplace, as described in claim 7, wherein said first and second annular walls are converging walls extending in the direction of said chimney flue.

9. A fireplace, as described in claim 8, wherein said first and second flue outlet openings are in vertical alignment with said chimney flue.

10. A fireplace comprising:

a plurality of walls defining a combustion chamber;

a first, generally horizontally oriented top wall member positioned directly above the combustion chamber and including a first flue outlet opening;

a second, generally horizontally oriented top wall member including a second flue outlet opening, said second top wall member being positioned vertically above and adjacent to said first top wall member such that a space is defined between said first and second top wall members and said first and second flue outlet openings are in substantial vertical alignment;

means for introducing cooling air into said space between said first and second top wall members;

a chimney flue communicating with said combustion chamber and said first and second flue outlet openings; and said combustion chamber, said first and second top wall members, said means for introducing cooling air, and said chimney flue being arranged such that combustion gases exiting the combustion chamber pass through the first and second flue outlet openings, respectively, thereby drawing cooling air into the space between the first and second top wall members and mixing therewith prior to exiting from the chimney flue.

11. A fireplace as described in claim 10 wherein said first top wall member includes a plurality of small openings extending therethrough.

12. A fireplace as described in claim 10 wherein each of said first and second top wall members has a generally rectangular configuration.

13. A fireplace as described in claim 10 wherein each of said first and second top wall members has a generally dome-shaped configuration.

14. A fireplace as described in claim 10 wherein the walls defining the first top wall member are substantially parallel to the walls defining the second top wall member.

15. A fireplace as described in claim 10 including a plurality of openings communicating said space with a source of cooling air, said openings being adjacent to said first top wall.

16. A fireplace as described in claim 10 wherein said first and second flue outlet openings are in vertical alignment with the chimney flue.

* * * * *